US010223943B2

(12) United States Patent
Clarke

(10) Patent No.: US 10,223,943 B2
(45) Date of Patent: Mar. 5, 2019

(54) DOUBLE SIDED BRACKET FOR A LIGHT ASSEMBLY

(71) Applicant: As Seen on PC, Inc., Fairfield, CT (US)

(72) Inventor: Curtis Allen Clarke, Fairfield, CT (US)

(73) Assignee: AS SEEN ON PC, INC., Fairfield, CT (US)

( * ) Notice: Subject to any disclaimer, the term of this patent is extended or adjusted under 35 U.S.C. 154(b) by 0 days.

(21) Appl. No.: 15/418,067

(22) Filed: Jan. 27, 2017

(65) Prior Publication Data

US 2018/0218652 A1 Aug. 2, 2018

(51) Int. Cl.

| | |
|---|---|
| ***F21S 8/00*** | (2006.01) |
| ***F21S 13/02*** | (2006.01) |
| ***G09F 13/02*** | (2006.01) |
| ***F21S 9/03*** | (2006.01) |
| ***F21V 21/26*** | (2006.01) |
| ***F21V 21/08*** | (2006.01) |

(52) U.S. Cl.

CPC ..... *G09F 13/02* (2013.01); *F21S 9/03* (2013.01); *F21V 21/08* (2013.01); *F21V 21/26* (2013.01)

(58) Field of Classification Search

CPC .... F21S 8/00; F21S 9/03; F21V 21/00; F21V 21/08; F21V 21/14; F21V 21/26; F21V 21/34; G09F 13/02; G09F 13/04

USPC .... 362/217.1–217.17, 249.02, 382, 432, 457

See application file for complete search history.

(56) References Cited

U.S. PATENT DOCUMENTS 4,327,513 A * 5/1982 de Gunzburg ..... G09F 13/0413 40/572

7,231,735 B2 * 6/2007 Gelbert ..... G09F 7/22 40/541

* cited by examiner

*Primary Examiner* — Jason M Han

(74) *Attorney, Agent, or Firm* — Ziegler IP Law Group, LLC

(57) ABSTRACT

A double sided bracket assembly includes a main member, a first end member extending from one end of the main member, a second end member extending from an other end of the main member, the first end member and second end member being disposed at an angle relative to the main member. A first angled bracket member and a second angled bracket member are disposed on an underside of the main member, the first angled bracket member and the second angled bracket member being movable with respect to the main member. A first edge member and a second edge member extend from respective longitudinal sides of the main member, the first edge member and second edge member configured to retain the first bracket member and second bracket member in a channel defined by the first edge member and second edge member.

17 Claims, 15 Drawing Sheets

DOUBLE SIDED BRACKET FOR A LIGHT ASSEMBLY

TECHNICAL FIELD

The aspects of the present disclosure relate generally to brackets, and more particularly a double sided bracket for attaching light fixtures to a sign.

BACKGROUND

Outdoor signs will typically make use of one or more lights to make the sign visible when it is dark out. In some cases the light is on the ground and shines on the sign. In other cases, the light might be on a pole. There are also setups where the light is mounted to a top portion of the sign. In most of these cases, the light is a separate assembly and also requires separate electrical power connections.

Real estate signs, such as a "FOR SALE" sign, are usually temporary in nature and not installed by the homeowner. Typically, such a sign consists of a stand that has a vertical post member and a horizontal post member. The sign portion is attached to the horizontal post member. Since the post and sign is typically temporarily installed by the real estate company and not the homeowner, there is generally not access to electrical power. This can pose difficulties in illuminating the sign in dark conditions, such as the evening or at night. While battery and solar powered lights are available, it can be problematic to install and align the lights to provide accurate illumination.

Even where electrical power may be available, the use of electrical cords to power sign lights can be cumbersome and unsightly. It can also be challenging to set up lighting that illuminates both sides of a sign in an accurate and consistent manner. It would be advantageous to provide a bracket that can be easily and removably attached to a sign or sign post, and which allows both sides of the sign to be lit.

Accordingly, it would be desirable to provide a bracket assembly that addresses at least some of the problems identified above.

SUMMARY

The aspects of the disclosed embodiments provide a double sided bracket assembly. The bracket assembly can be mounted on a sign post. Lamps or lights can be attached to ends to the bracket assembly. The lights can be directed to illuminate the sign.

According to a first aspect, the disclosed embodiments are directed to a double sided bracket assembly. In one embodiment, the double sided bracket assembly includes a main member, a first end member extending from one end of the main member, a second end member extending from an other end of the main member, the first end member and second end member being disposed at an angle relative to the main member. A first angled bracket member and a second angled bracket member are disposed on an underside of the main member, the first angled bracket member and the second angled bracket member being movable with respect to the main member. A first edge member and a second edge member extend from respective longitudinal sides of the main member, the first edge member and second edge member configured to retain the first bracket member and second bracket member in a channel defined by the first edge member and second edge member.

According to a second aspect, the aspects of the disclosed embodiments are directed to a lighting assembly that includes a double sided bracket assembly. In one embodiment, the double sided bracket assembly comprising a main member and two end members coupled to and disposed at an angle relative to the main member, the main member including an angled bracket assembly that is configured to secure the double sided bracket assembly to the sign between two repositionable bracket members. A pair of lights are attached to the double sided bracket assembly where one light from the pair of lights is attached to a respective end member of the two end members of the double sided bracket assembly These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

In the following detailed portion of the present disclosure, the invention will be explained in more detail with reference to the example embodiments shown in the drawings, in which.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE DISCLOSED EMBODIMENTS

As described herein, the exemplary embodiments overcome one or more of the above or other disadvantages known in the art.

Figure 1:
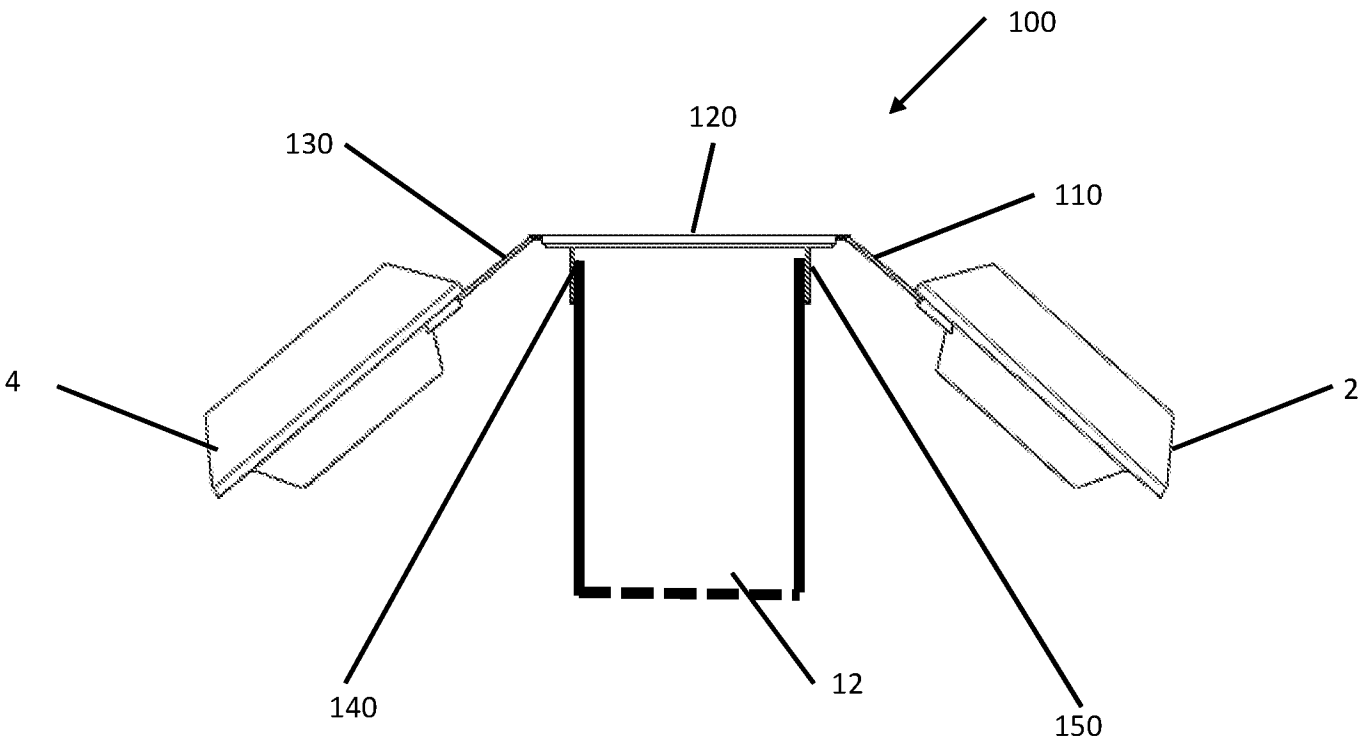
FIG. 1 is side view of one embodiment of a bracket assembly incorporating aspects of the disclosed embodiments as installed on a sign.

FIG. 1 illustrates a one embodiment of a double sided bracket and light assembly 100 incorporating aspects of the disclosed embodiments. In this example, the bracket assembly 110 is installed on a sign or sign post 12 and includes lights 2 and 4 installed on each side of the bracket assembly 100. The aspects of the disclosed embodiments are configured to provide a bracket assembly 100 that can be mounted to a portion of a sign 12, such as on top of the sign 12 as shown in FIG. 1. Each end of the bracket assembly 100 can have a light 2, 4 attached thereto. For the purposes of the description herein, the lights 2, 4 will be described as battery operated or solar powered lights. The lights 2, 4 can include suitable timers or photosensors that allow the lights 2, 4 to be operated during dusk or evening hours, or other time periods when there is not sufficient light to adequately see the sign.

The bracket assembly 100, with the lights 2, 4 attached, can be easily and quickly attached to the sign 12. While the bracket assembly 100 is generally described as being attached to the top of the sign 12, the aspects of the disclosed embodiments are not so limited. In alternate embodiments, the bracket assembly 100 can be attached to any suitable portion of sign 12, such as a side or even the bottom. In this manner, the lights 2, 4 can be used to keep both sides 16, 18 of the sign 12 lit.

Figure 2:
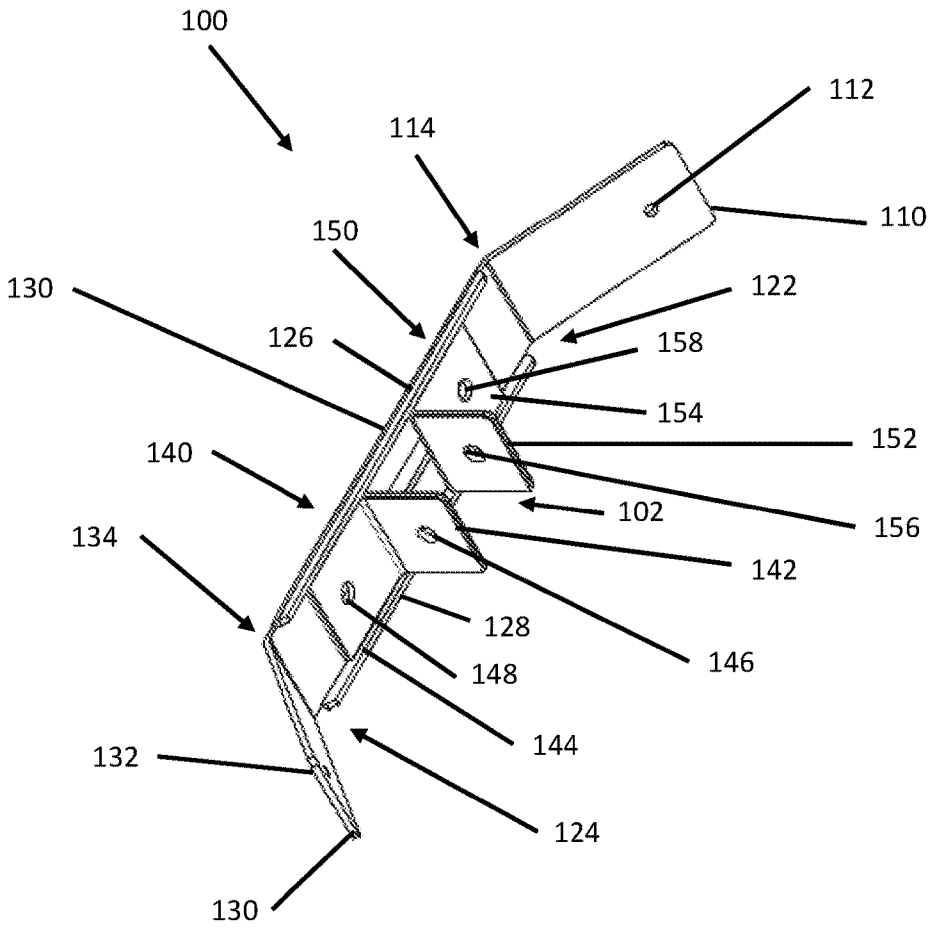
FIG. 2 is a bottom left perspective view of one embodiment of a double sided bracket.

FIG. 2 is a bottom side perspective view of one embodiment of the bracket assembly 100 illustrated in FIG. 1. In this example, the bracket assembly 100 includes a first end member 110 and a second end member 130. A middle member 120 joins the first end member 110 and the second end member 130.

The first end member 110 extends away from the middle member 120. In one embodiment, the first end member 110, which can also be referred to as a first bent or angled member, is disposed at an angle generally indicated by reference 122 relative to the middle member 120. The angle 122 in the example of FIG. 1 is in the range of approximately 90 degrees to and including 175 degrees. A preferred angle is in the range of approximately 110 degrees to and including 145 degrees. In alternate embodiments, the angle 122 of the first end member 110 relative to the middle member 120 can be any suitable angle that allows the light 2 to illuminate the sign 12 shown in FIG. 1 in a desired manner.

The second end member 130 extends away from the middle member 120. In the example of FIG. 1, the second end member 130 is extending away from the middle member 120 in a direction that is substantially opposite the first end member 110. Thus, the bracket assembly 100 has a middle member 120, with a first end or angled member 110 on one side and a second end or angled member 130 on the other side.

In one embodiment, the second end member 130 is disposed at an angle indicated by reference 124 relative to the middle member 120. The angle 124 in the example of FIG. 1 is generally the same as the angle 122. For example, similar to what is described above, the angle 124 can be in the range of approximately 90 degrees to and including 175 degrees. A preferred angle is in the range of approximately 110 degrees to and including 145 degrees. In alternate embodiments, the angle 124 can be any suitable angle that allows the light 4 to illuminate the sign 12 shown in FIG. 1 in a desired manner.

In the example of FIG. 1, the first end member 110 and the second end member 130 are shown as substantially fixed in position. Thus, the angles 122, 124 are generally a function of the fabrication of the bracket assembly 110. For example, in one embodiment, the first end 110, the middle portion 120 and the second end 130 form a single piece, or single piece construction. The first ends 110 and second ends 120 can be bent relative to the middle portion 120. However, the aspects of the disclosed embodiments are not so limited. In one embodiment, the positioning of the first end 110 and the second end 130 relative to the middle portion 120 can be adjustable.

For example, the first end portion 110 and the middle portion 120 can be coupled together using a pivot assembly 124, such as a pin or hinge. The pivot assembly can have a number of pre-determined positions or stops in the range of 90 degrees to and including 180 degrees. In one embodiment, the pivot assembly can comprises a friction lock type assembly that allows the first end portion 110 to be arranged at any suitable angle relative to the middle portion, such as to and including between 90 and 180 degrees.

Similarly, the second end portion 130 and the middle portion 120 can be coupled together using a pivot assembly 134, such as a pin or hinge. The pivot assembly can have a number of pre-determined positions or stops in the range of 90 degrees to and including 180 degrees. In one embodiment, the pivot assembly can comprises a friction lock type assembly that allows the first end portion 110 to be arranged at any suitable angle relative to the middle portion, such as to and including between 90 and 180 degrees. In alternate embodiments, the pivot assembly can include any suitable mechanism that allows the first end member 110 and the second end member 130 to be adjusted and readjusted to any suitable or desired angle relative to the middle member.

In one embodiment, the angles 122, and 124 may not be the same. The aspects of the disclosed embodiments provide for the angle 122 of the bracket assembly 100 to be different from the angle 124. This can be desirable depending upon the particular application, In the example of FIG. 2, in one embodiment, the first end portion 110 includes an engagement opening or aperture 112. The opening 112 can comprise a through hole that engages a corresponding mounting mechanism for the light 2 shown in FIG. 1. Similarly, the second end portion 130 can include an engagement opening or aperture 132. The opening 132 can comprise a through hole that engages a corresponding mounting mechanism for the light 4 shown in FIG. 1. Although the openings 112, 132 are shown as being round or circular, the aspects of the disclosed embodiments are not so limited. In alternate embodiments, the shape of the openings 112, 132 can comprise any suitable shape, such as for example square or rectangular.

The middle portion or member 120 shown in FIG. 2 can also include guide members or rails 126, 128. The guide members 126, 128 are disposed in a substantially parallel manner on either side or edge portion of the middle member 120. In the example of FIG. 1, the guide members are disposed in a length wise fashion on the middle member 120. In the example of FIG. 2, the guide members 126, 128 extend from substantially the first end 110 to the second end 130. In some cases, there can be a gap between the first end 110 and the guide members 126, 128 and the second end 130 and the corresponding ends of the guide members 126, 128.

The guide members 126, 128 will have a height that extends away from a surface of the middle member 120. In the example of FIGS. 1 and 2, the guide members will extend from the surface of the middle member 120 in a direction towards the mounting portion for the sign 12. In one embodiment, the height can be in the range of approximately 0.0625 inches to an including approximately 0.375 inches. The height can vary on the particular application. For example, in one embodiment, the height of the guide members 126, 128 is approximately twice the thickness of one of the sides 110, 112.

As is illustrated in FIG. 2, in one embodiment, a pair of angled bracket members 140, 150 are disposed in or on the middle member 120, between the guide members 126, 128. Each angled member 140, 150 is configured to be disposed on a respective side portion of the middle member 120. Generally, there will be a gap or space 102 between the angled bracket member 140 and the angled bracket member 150. The gap 102 is generally configured to accommodate the width of the sign 12. The size of the gap 102, which in one embodiment, as will be described further herein, is adjustable, depending upon the movement and positioning of the angled members 140, 150.

The angled members 140, 150 are generally similar in construction shape and size. Angled member 140 includes a first bracket member 142 and a second bracket member 144. The first bracket member 142 and the second bracket member 144 are generally disposed at right angles or substantially perpendicular to each other.

In one embodiment, the first bracket member 142 includes a hole or aperture 146, while the second bracket member 144 includes a hole or aperture 148. Although the openings 146 and 148 are described herein as holes, in alternate embodiments the openings 146, 148 can comprise any suitable geometric shape or structure, such as a square or rectangle, for example.

Similar to the angled member 140, the angled member 150 includes a first bracket member 152 and a second bracket member 154. The first bracket member 152 and the second bracket member 154 are generally disposed at right angles or substantially perpendicular to each other.

In one embodiment, the first bracket member 152 includes a hole or aperture 156, while the second bracket member 154 includes a hole or aperture 158. Although the openings 156 and 158 are described herein as holes, in alternate embodiments the openings 156, 158 can comprise any suitable geometric shape or structure, such as a square or rectangle, for example.

Figure 5:
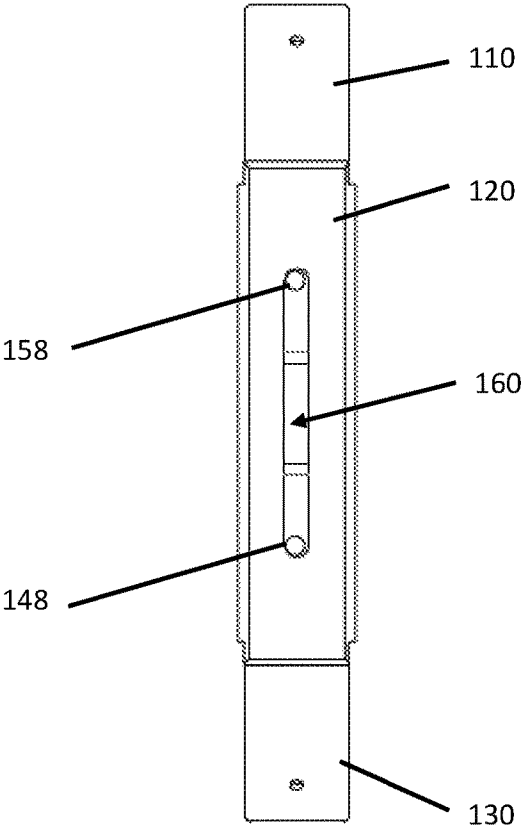
FIGS. 5 and 6 are top views of embodiments of the double sided bracket shown in FIG. 1.

The middle member 120 can also include an elongate aperture 160, as is shown in FIGS. 2 and 5, for example. The apertures 148 and 158 are configured to align with the elongate aperture 160. In one embodiment, a retaining member, such as a screw or bolt is configured to be disposed in or inserted into each of the apertures 148, 158 and the elongate aperture 160 to secure the respective angled member 140, 150 in a position with respect to the middle member 120.

While the aspects of the disclosed embodiments are described with respect to a retaining member being inserted into the respective apertures 148, 158 and the aperture 160, the aspects of the disclosed embodiments are not so limited. In one embodiment, instead of apertures 148, 158, the angled members 140, 150 can have a retaining member such as a post member extending from where the aperture 148, 158 would otherwise be. The post member can be fixed to a surface of the respective angled member 140, 150. In one embodiment, the post member can be threaded and used to secure the respective angled member 140, 150 to the main member such as by threading a nut on the post. In alternate embodiments, the post member can comprise any suitable retaining or fixation device such as a friction lock device or snap-lock device. This provides the advantage to reduce the number of parts required.

Figure 10:
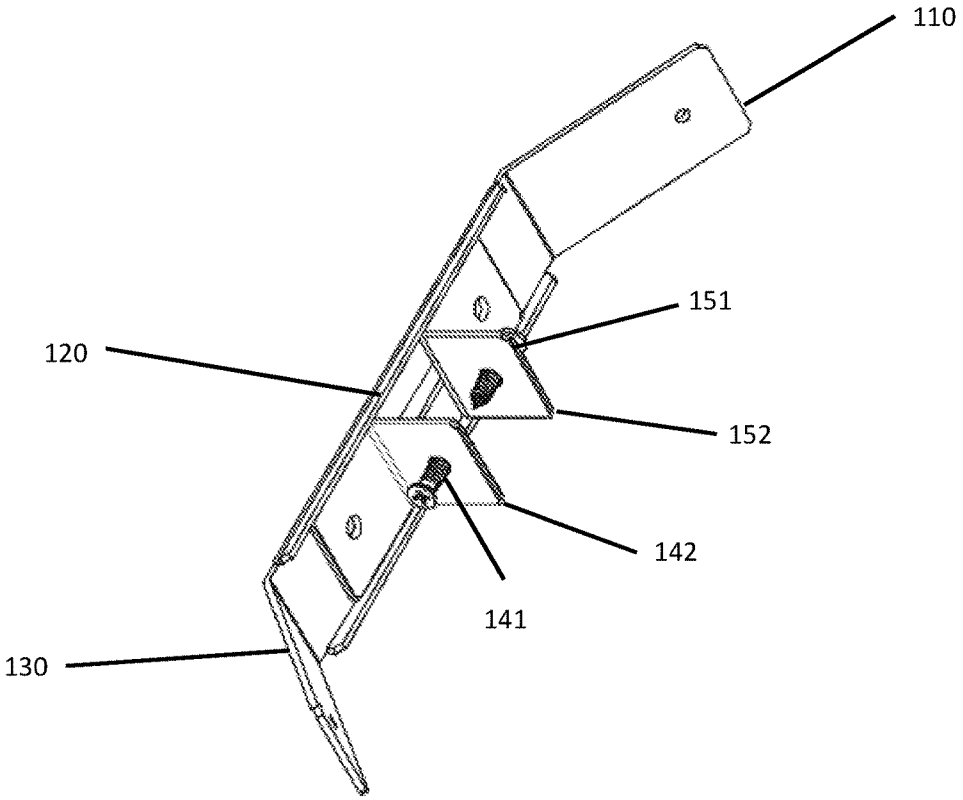
FIG. 10 is bottom left perspective view of an embodiment of the double sided bracket showing the use of screws to retain the bracket to the sign.
Figure 11:
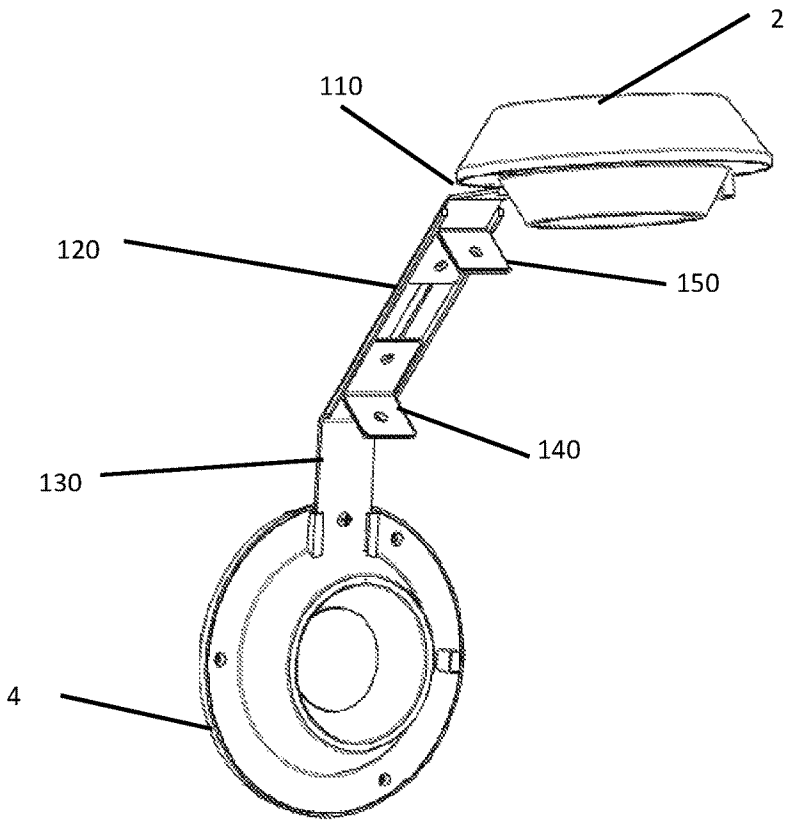
FIG. 11 is a bottom left perspective view of an embodiment of the double sided bracket of FIG. 1 with the light fixtures mounted thereon.

The angled members 140, 150 are configured to be aligned in any suitable position with respect to the middle member 120. In one embodiment, each angled member 140, 150 is aligned with a respective side of the sign 12 shown in FIG. 1. A retaining device, such as screws 141, 151 shown in FIGS. 1 and 10 can be used to secure the respective angled member 140, 150 to the sign 12. The screws 141, 151 will go through the respective openings 146, 156 and into the sign 12.

Figure 8:
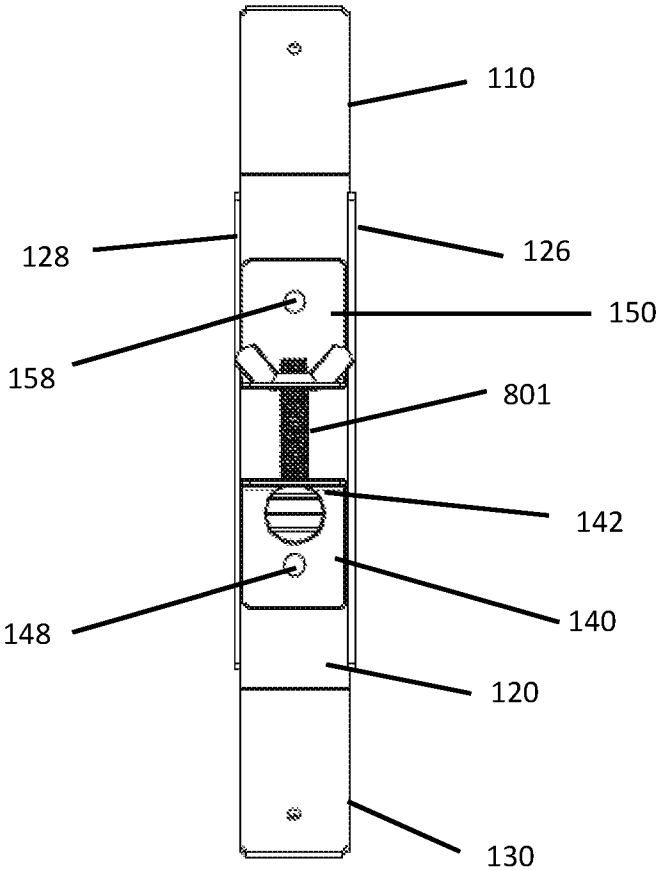
FIG. 8 is a bottom view of one embodiment of the double sided bracket showing the use of a bolt.
Figure 9:
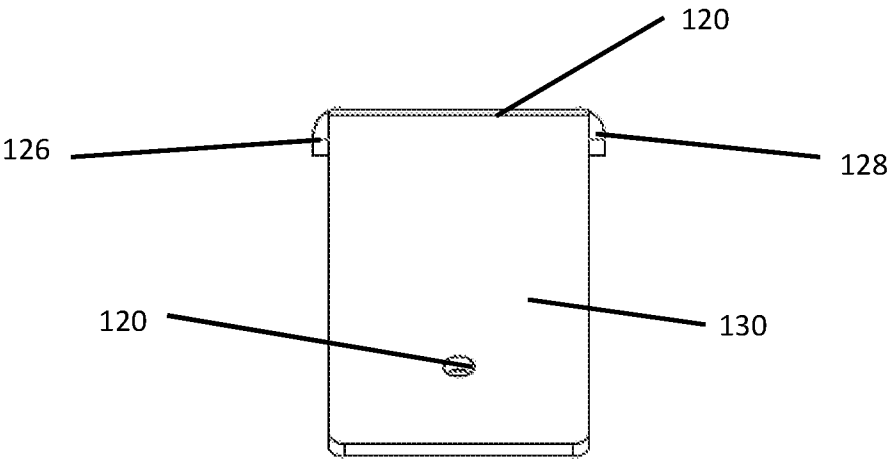
FIG. 9 is a right side view of the double sided bracket shown in FIG. 2, the left side being substantially the same.

In one embodiment, referring to FIG. 8 for example, a bolt 801 is inserted through the openings 146, 156 and also through a corresponding hole in the sign 12 (not shown in FIG. 8). In this manner, the sign 12 can be predrilled with a mounting hole.

Figure 3:
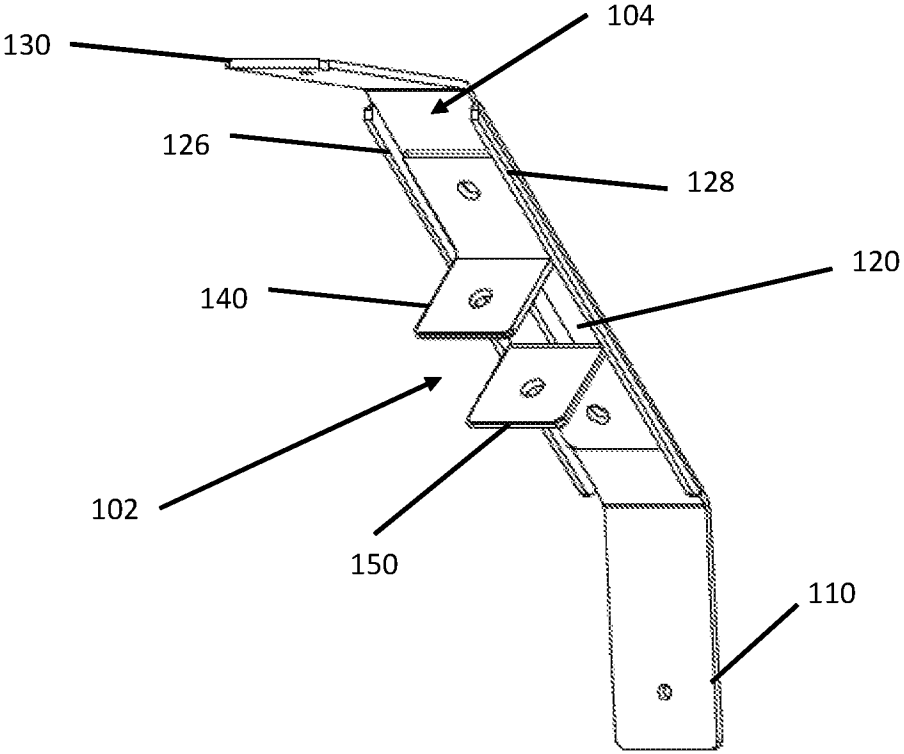
FIG. 3 is a bottom right perspective view of double sided bracket shown in FIG. 2.
Figure 4:
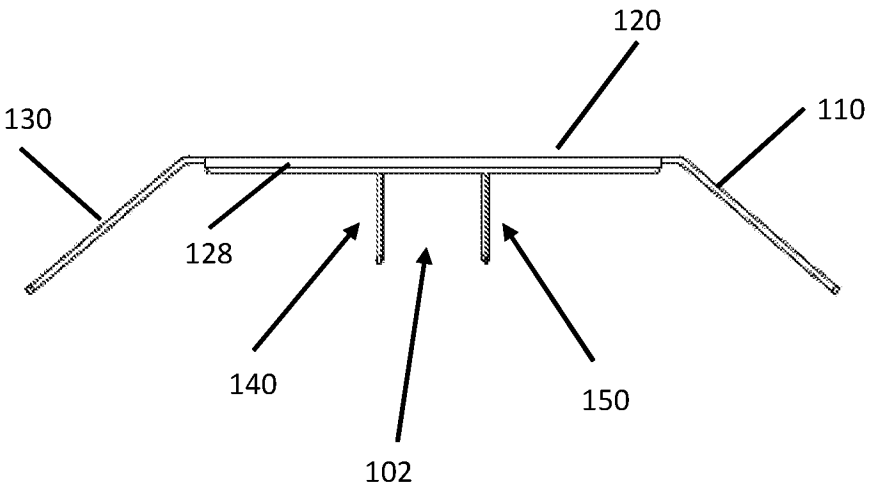
FIG. 4 is front view of double sided bracket shown in FIG. 2, the back view being substantially the same.

In the example of FIG. 2, the angled or bracket members 140, 150 are free floating, meaning that they can be moved and positioned to any suitable location on the middle member 120 with respect to the channel 160. Referring also to FIG. 3, the guide members 126, 128 only retain the angled members 140, 150 in an opening 104 formed between the guide members 126, 128. While sideways motion of the angled members 140, 150 in the opening or channel 104 is restrained by the guide members 126, 128, the angled members 140, 150 can be positioned or slid along the length of the middle member 120 between the guide members 126, 128 to any suitable position. In one embodiment, each guide member 126, 128 could include a lip member on an edge that retrains or retains the angled member 140, 150 within the channel 104 when the bracket assembly 100 is maintained in a horizontal state, such as shown in FIG. 4. On other words, the guide members 126, 128 can include respective lip or edge members that keep the angled members 140, 150 from falling out when in the position shown in FIG. 4. This would allow the angled members 140, 150 to slide within the channel 104.

Figure 12:
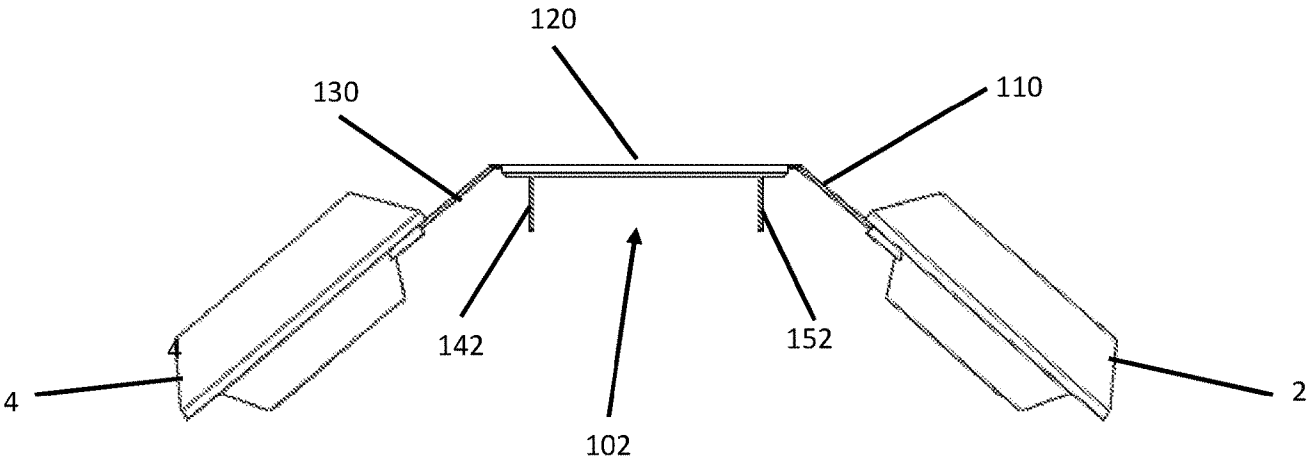
FIG. 12 is a front view of the embodiment shown in FIG. 11.
Figure 13:
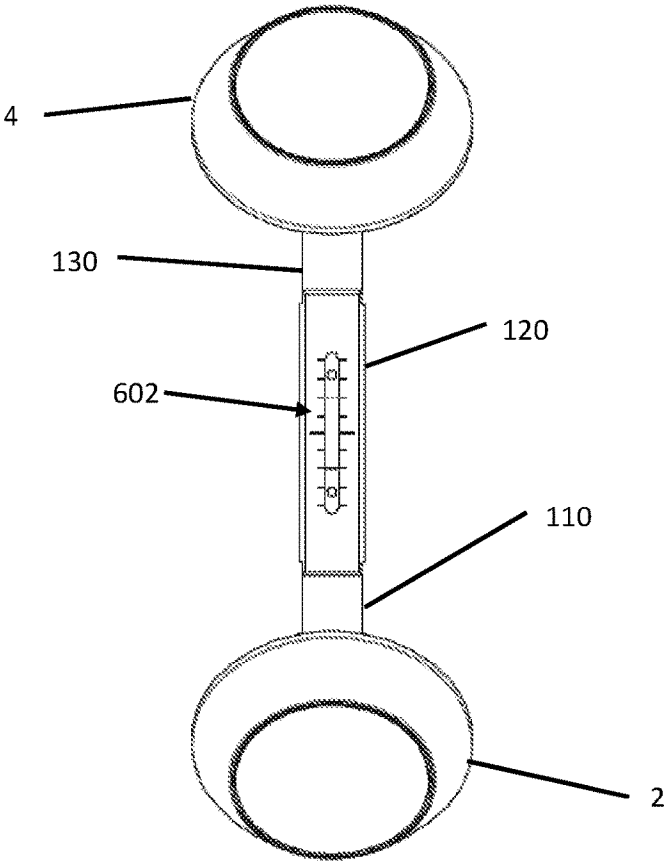
FIG. 13 is a top view of the embodiment shown in FIG. 11.
Figure 14:
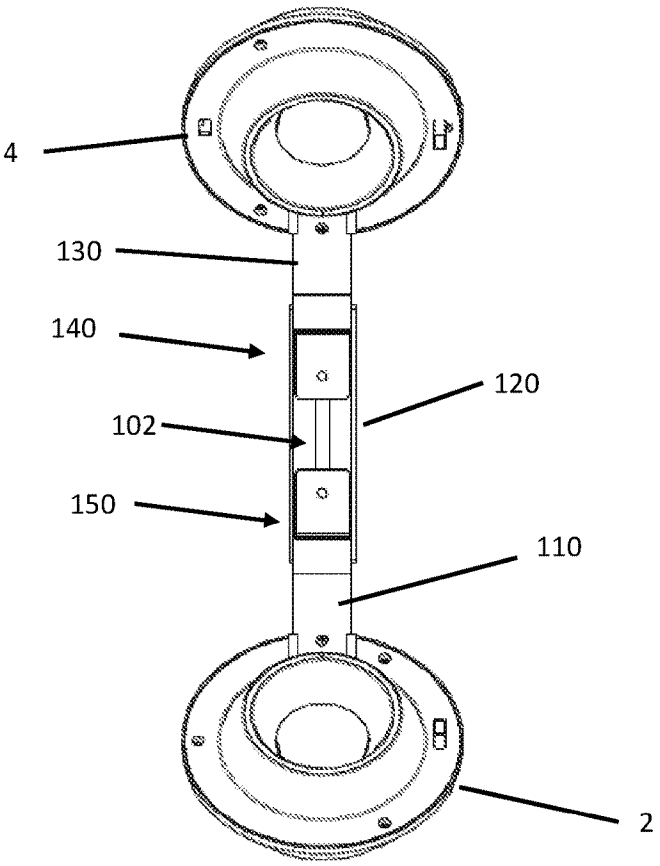
FIG. 14 is a bottom view of the embodiment shown in FIG. 11.
Figure 15:
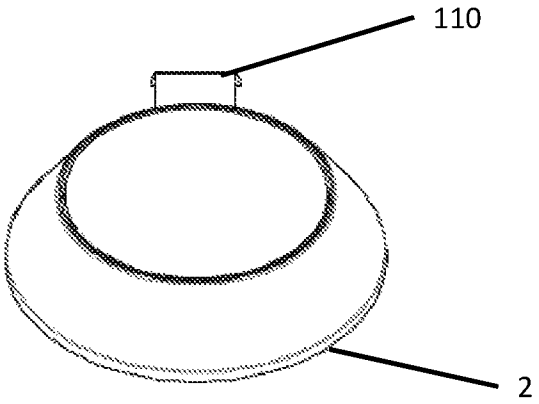
FIG. 15 is an end view of the embodiment shown in FIG. 11.

In the example of FIG. 2, angled member 140 and the angled member 150 are disposed or positioned so that the respective bracket members 142 and 152 are proximate to each other. In the example of FIG. 12, the angled member 140 and the angled member 150 are disposed or positioned so that the respective bracket members 142 and 152 are distal from or away from each other. In other words, in the example of FIG. 14, the angled members 140, 150 are turned around relative to the example of FIG. 2. For example, a sign may have a width of a few inches, while a sign post may have a width of 4 to 6 inches. The bracket assembly 100 of the disclosed embodiments allows signs and sign posts of various widths to be accommodated.

Figure 6:
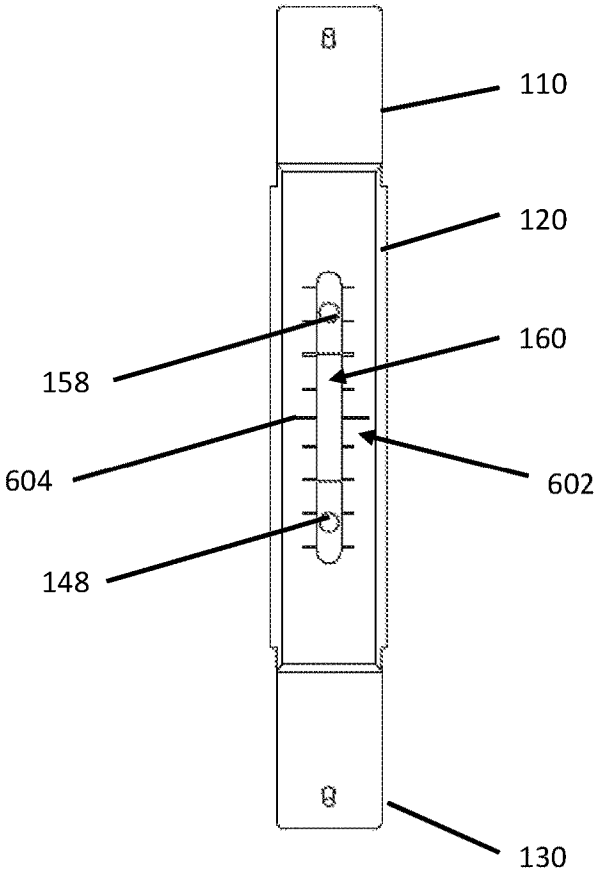
Figure 7:
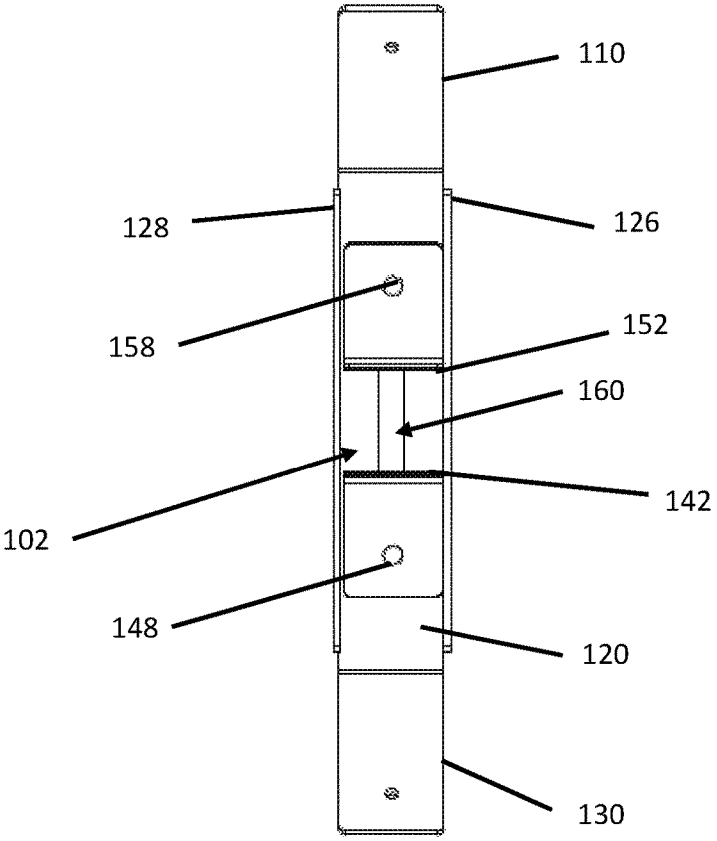
FIG. 7 is a bottom view of one embodiment of the double sided bracket.

Referring to FIG. 6, in one embodiment, the middle member 120 can include graduations or marks 602 on one or both sides. In the example of FIG. 6, the marks 602 are provided on a top side of the middle member 120, opposite the opening 102 and the angled members 140, 150. The respective apertures 148, 158 can be aligned with different ones of the marks 602. In one embodiment, the apertures 148, 158 can be aligned substantially equidistant from a central mark 604, as indicated by the marks 602. This allows the angled members 140, 150 and the lights 2, 4 to be positioned substantially the same distance from the sign on either side.

The lights 2, 4 shown in FIG. 1 can be any suitable light assembly that can be used to illuminate a sign. In one embodiment, the lights 2, 4 comprise solar powered lights. The lights 2, 4 will generally be suitable for outside use and configured to be attached to the respective ends of the bracket assembly 100 as is described herein.

Thus, while there have been shown, described and pointed out, fundamental novel features of the invention as applied to the exemplary embodiments thereof, it will be understood that various omissions, substitutions and changes in the form and details of devices and methods illustrated, and in their operation, may be made by those skilled in the art without departing from the spirit and scope of the presently disclosed invention. Further, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A double sided bracket assembly, the bracket assembly comprising:

a main member;

a first end member extending from one end of the main member;

a second end member extending from an other end of the main member;

the first end member and second end member being disposed at an angle relative to the main member;

a first angled bracket member and a second angled bracket member disposed on an underside of the main member, the first angled bracket member and the second angled bracket member being movable with respect to the main member;

a first edge member and a second edge member extending from respective longitudinal sides of the main member, the first edge member and second edge member configured to retain the first bracket member and second bracket member in a channel defined by the first edge member and second edge member;

wherein the first angled bracket member comprises a first bracket member and a second bracket member, the first bracket member and the second bracket member being disposed at a right angle relative to one another and the second angled bracket member comprises a first bracket member and a second bracket member, the first bracket member and the second bracket member being disposed at a right angle relative to one another, and the first bracket member of the first angled member comprises a first retaining member and the first bracket member of the second angled member comprises a second retaining member, the first retaining member and the second retaining member configured to be received in an elongate aperture defined in the main member.

2. The double sided bracket assembly according to claim 1, further comprising a first light assembly coupled to an end of the first end member and a second light assembly coupled to an end of the second end member.

3. The double sided bracket assembly according to claim 2 wherein the first light assembly and the second light assembly comprises a solar powered LED light.

4. The double sided bracket assembly according to claim 1 wherein the second bracket member of the first angled member includes an aperture and the second bracket member of the second angled member includes an aperture, wherein both apertures are configured to receive a corresponding fastening member to secure the respective second bracket member to a sign member.

5. The double sided bracket assembly according to claim 4, wherein the fastening member comprises a screw.

6. The double sided bracket assembly according to claim 4, where the fastening member comprises a bolt and nut assembly.

7. The double sided bracket assembly according to claim 4 wherein the second bracket member of the first angled member and the second bracket member of the second angled member defines a gap, the gap configured to receive the sign member.

8. The double sided bracket assembly according to claim 7, wherein the first angled member and the second angled member are repositionable relative to one another along a length of the main member to vary a size of the gap.

9. The double sided bracket assembly according to claim 1, the first end member and the second end member are repositionable relative to vary the angle relative to the main member.

10. The double sided bracket assembly according to claim 9 further comprising a first hinge assembly coupling the main member to the first end member and a second hinge assembly coupling the main member to the second end member.

11. The double sided bracket assembly according to claim 10 wherein the first hinge assembly and the second hinge assembly comprises a friction lock device.

12. A lighting assembly for a sign, comprising:

a double sided bracket assembly comprising a main member and two end members coupled to and disposed at an angle relative to the main member, the main member including an angled bracket assembly that is configured to secure the double sided bracket assembly to the sign between two repositionable bracket members; and a pair of lights, one light from the pair of lights attached to a respective end member of the two end members of the double sided bracket assembly and wherein the angled bracket assembly of the double sided bracket assembly comprises:

a first angled bracket member and a second angled bracket member disposed on an underside of the main member, the first angled bracket member and the second angled bracket member being movable and repositionable in a channel defined on one side of the main member;

the first angled bracket member comprises a first bracket member and a second bracket member, the first bracket member and the second bracket member being disposed at a right angle relative to one another and the second angled bracket member comprises a first bracket member and a second bracket member, the first bracket member and the second bracket member being disposed at a right angle relative to one another; and the first bracket member of the first angled bracket member comprises a first retaining member and the first bracket member of the second angled bracket member comprises a second retaining member, the first retaining member and the second retaining member configured to be received in an elongate aperture defined in the main member.

13. The lighting assembly according to claim 12 wherein the pair of lights comprises solar powered LED lights.

14. The lighting assembly according to claim 12, wherein the main member comprises a first edge member and a second edge member extending from respective longitudinal sides of the main member, the first edge member and second edge member defining the channel of the main member, the first edge member and second edge member configured to restrain sideways motion of the first bracket member and second bracket member in the channel and enable longitudinal movement of the first bracket member and the second bracket member in the channel.

15. The lighting assembly according to claim 14, wherein the second bracket member of the first angled member includes an aperture and the second bracket member of the second angled member includes an aperture, wherein both apertures are configured to receive a corresponding fastening member to secure the respective second bracket member to the sign.

16. The lighting assembly according to claim 15, wherein the second bracket member of the first angled member and the second bracket member of the second angled member defines a gap, the gap configured to receive the sign.

17. The lighting assembly according to claim 16 wherein the first angled member and the second angled member are repositionable relative to one another in the channel along a length of the main member to vary a size of the gap.

* * * * *